US007138768B2

(12) United States Patent
Maciejowski et al.

(10) Patent No.: US 7,138,768 B2
(45) Date of Patent: Nov. 21, 2006

(54) INDIRECTLY HEATED CATHODE ION SOURCE

(75) Inventors: Peter E. Maciejowski, Amesbury, MA (US); Joseph C. Olson, Beverly, MA (US); Shengwu Chang, Newburyport, MA (US); Bjorn O. Pedersen, Chelmsford, MA (US); Leo V. Klos, Jr., Newburyport, MA (US); Daniel Distaso, Merrimac, MA (US); Curt D. Bergeron, Danvers, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 0 days.

(21) Appl. No.: 10/154,232

(22) Filed: May 23, 2002

(65) Prior Publication Data

US 2003/0218428 A1 Nov. 27, 2003

(51) Int. Cl.
*H01J 7/24* (2006.01)

(52) U.S. Cl. ..... 315/111.81; 250/427

(58) Field of Classification Search .....
315/111.01–111.91, 3.5; 313/441, 451, 313/456, 360.1, 363.1; 378/136, 138; 250/427, 250/423 R, 423 F
See application file for complete search history.

(56) References Cited

U.S. PATENT DOCUMENTS

| | | | | |
|---|---|---|---|---|
| 3,621,324 | A | 11/1971 | Fink | |
| 3,979,634 | A * | 9/1976 | Jaillet et al. | 313/441 |
| 4,573,186 | A * | 2/1986 | Reinhold | 378/138 |
| 4,714,834 | A * | 12/1987 | Shubaly | 315/111.81 |
| 5,204,145 | A * | 4/1993 | Gasworth | 427/577 |
| 5,262,652 | A | 11/1993 | Bright et al. | |
| 5,497,006 | A | 3/1996 | Sferlazzo et al. | |
| 5,517,077 | A | 5/1996 | Bright et al. | |
| 5,554,852 | A | 9/1996 | Bright et al. | |
| 5,703,372 | A | 12/1997 | Horsky et al. | |
| 5,763,890 | A * | 6/1998 | Cloutier et al. | 250/427 |
| 5,886,355 | A | 3/1999 | Bright et al. | |
| 6,348,764 | B1 * | 2/2002 | Chen et al. | 315/111.81 |
| 6,452,338 | B1 * | 9/2002 | Horsky | 315/111.81 |
| 6,777,686 | B1 * | 8/2004 | Olson et al. | 250/423 R |
| 2001/0042836 | A1 | 11/2001 | Varian | |
| 2001/0043040 | A1 | 11/2001 | Varian | |

FOREIGN PATENT DOCUMENTS

| | | |
|---|---|---|
| CH | 252249 | 12/1947 |
| EP | 0215626 | 3/1987 |
| EP | 0840346 | 5/1998 |
| EP | 0851453 | 7/1998 |
| FR | 1053508 | 2/1954 |

(Continued)

*Primary Examiner*—Wilson Lee

(57) ABSTRACT

An indirectly heated cathode ion source includes an arc chamber housing that defines an arc chamber, an indirectly heated cathode and a filament for heating the cathode. The cathode may include an emitting portion having a front surface, a rear surface and a periphery, a support rod attached to the rear surface of the emitting portion, and a skirt extending from the periphery of the emitting portion. A cathode assembly may include the cathode, a filament and a clamp assembly for mounting the cathode and the filament in a fixed spatial relationship and for conducting electrical energy to the cathode and the filament. The filament is positioned in a cavity defined by the emitting portion and the skirt of the cathode. The ion source may include a shield for inhibiting escape of electrons and plasma from a region outside the arc chamber in proximity to the filament and the cathode.

29 Claims, 8 Drawing Sheets

FOREIGN PATENT DOCUMENTS

| | | |
|---|---|---|
| FR | 2105407 | 11/1971 |
| GB | 2327513 | 1/1999 |
| WO | WO 97/32335 | 9/1997 |
| WO | WO 99/04409 | 1/1999 |

* cited by examiner

INDIRECTLY HEATED CATHODE ION SOURCE

FIELD OF THE INVENTION

This invention relates to ion sources that are suitable for use in ion implanters and, more particularly, to ion sources having indirectly heated cathodes.

BACKGROUND OF THE INVENTION

An ion source is a critical component of an ion implanter. The ion source generates an ion beam which passes through the beamline of the ion implanter and is delivered to a semiconductor wafer. The ion source is required to generate a stable, well-defined beam for a variety of different ion species and extraction voltages. In a semiconductor production facility, the ion implanter, including the ion source, is required to operate for extended periods without the need for maintenance or repair.

Ion implanters have conventionally used ion sources with directly heated cathodes, wherein a filament for emitting electrons is mounted in the arc chamber of the ion source and is exposed to the highly corrosive plasma in the arc chamber. Such directly heated cathodes typically constitute a relatively small diameter wire filament and therefore degrade or fail in the corrosive environment of the arc chamber in a relatively short time. As a result, the lifetime of the directly heated cathode ion source is limited. As used herein, source "lifetime" refers to the time before repair or replacement of the ion source.

Indirectly heated cathode ion sources have been developed in order to improve ion source lifetimes in ion implanters. An indirectly heated cathode includes a relatively massive cathode which is heated by electron bombardment from a filament and emits electrons themionically. The filament is isolated from the plasma in the arc chamber and thus has a long lifetime. Although the cathode is exposed to the corrosive environment of the arc chamber, its relatively massive structure insures operation over an extended period.

The cathode in the indirectly heated cathode ion source must be electrically isolated from its surroundings, electrically connected to a power supply and thermally isolated from its surroundings to inhibit cooling which would cause it to stop emitting electrons. Known prior art indirectly heated cathode designs utilize a cathode in the form of a disk supported at its outer periphery by a thin wall tube of approximately the same diameter as the disk. The tube has a thin wall in order to reduce its cross-sectional area and thereby reduce the conduction of heat away from the hot cathode. The thin tube typically has cutouts along its length to act as insulating breaks and to reduce the conduction of heat away from the cathode.

The tube used to support the cathode does not emit electrons, but has a large surface area, much of it at high temperature. This area loses heat by radiation, which is the primary way that the cathode loses heat. The large diameter of the tube increases the size and complexity of the structure used to clamp and connect to the cathode. One known cathode support includes three parts and requires threads to assemble.

Another indirectly heated cathode configuration is disclosed in International Publication No. WO 01/88946 published Nov. 22, 2001. A disk-shaped cathode is supported by a single rod at or near its center. A cathode insulator electrically and thermally isolates the cathode from an arc chamber housing. The disclosed cathode assembly provides highly satisfactory operation under a variety of operating conditions. However, in certain applications, deposits of contaminants on the insulator may cause a short circuit between the cathode and the arc chamber housing, thereby requiring repair or replacement of the ion source.

All of the known prior art indirectly heated cathode ion sources have had one or more disadvantages, including, but not limited to, short operating lifetimes and excessive complexity. Accordingly, there is a need for improved indirectly heated cathode ion sources.

SUMMARY OF THE INVENTION

According to a first aspect of the invention, a cathode assembly is provided for use in an indirectly heated cathode ion source. The cathode assembly comprises a cathode including an emitting portion, a support rod attached to the emitting portion and a skirt extending from a periphery of the emitting portion, the skirt and the emitting portion defining a cavity, a filament for heating the emitting portion of the cathode positioned within the cavity in proximity to the emitting portion of the cathode, and a clamp assembly for mounting the cathode and the filament in a fixed spatial relationship and for conducting electrical energy to the cathode and the filament.

In some embodiments, the emitting portion of cathode is disk-shaped and has a front surface and a rear surface. The support rod may be attached at or near the center of the rear surface of the emitting portion. The skirt may be cylindrical and may extend rearwardly from the periphery of the emitting portion. The skirt functions to shield the filament from the plasma in the arc chamber of the ion source, but is not used for mechanical mounting of the cathode or for conducting electrical energy to the cathode.

The clamp assembly may include a cathode clamp affixed to the support rod of the cathode, first and second filament clamps affixed to first and second connecting leads of the filament, and an insulator block. The cathode clamp and the first and second filament clamps are mounted in fixed positions to the insulator block.

According to another aspect of the invention, a cathode is provided for use in an indirectly heated ion source. The cathode comprises an emitting portion having a front surface, a rear surface and a periphery, a support rod attached to the rear surface of the emitting portion, and a skirt extending from the periphery of the emitting portion.

According to a further aspect of the invention, an indirectly heated cathode ion source is provided. The indirectly heated cathode ion source comprises an arc chamber housing defining an arc chamber, an indirectly heated cathode positioned within the arc chamber, and a filament for heating the indirectly heated cathode. The indirectly heated cathode comprises an emitting portion having a front surface, a rear surface and a periphery, a support rod attached to the rear surface of the emitting portion and a skirt extending from the periphery of the emitting portion.

According to another aspect of the invention, an indirectly heated cathode ion source is provided. The indirectly heated cathode ion source comprises an arc chamber housing defining an arc chamber, an indirectly heated cathode positioned within the arc chamber, a filament positioned outside the arc chamber for heating the indirectly heated cathode, and a shield positioned outside the arc chamber in proximity to the filament and the indirectly heated cathode.

The ion source may further comprise a vacuum vessel enclosing the arc chamber, the indirectly heated cathode, the filament and the shield. The filament and the indirectly heated cathode are located on one side of the shield and an adjacent portion of the vacuum vessel is located on an opposite side of the shield. In some embodiments, the arc chamber housing and the vacuum vessel are at a common potential and the shield is at filament potential. In other embodiments, the vacuum vessel is connected to a reference potential and the shield is electrically floating.

The ion source may further comprise a clamp assembly for mounting the cathode and the filament in a fixed spatial relationship and for conducting electrical energy to the cathode and the filament. The shield may be mounted to the clamp assembly. The clamp assembly may comprise first and second filament clamps affixed to first and second connecting leads respectively, of the filament. In some embodiments, the shield is mechanically and electrically connected to one of the filament clamps. In other embodiments, the shield is mechanically mounted by electrical insulators to one of the filament clamps.

According to a further aspect of the invention, an indirectly heated cathode ion source is provided. The indirectly heated cathode ion source comprises an arc chamber housing defining an arc chamber, an indirectly heated cathode positioned within the arc chamber, a filament positioned outside the arc chamber for heating the indirectly heated cathode, wherein the indirectly heated cathode provides electrons for generating a plasma within the arc chamber, and means for inhibiting escape of the electrons and the plasma from a region outside the arc chamber in proximity to the filament and the indirectly heated cathode.

According to a further aspect of the invention, a method for operating an ion source is provided. The method comprises providing an arc chamber housing that defines an arc chamber, positioning an indirectly heated cathode within the arc chamber, heating the indirectly heated cathode with a filament positioned outside the arc chamber to provide electrons for generating a plasma within the arc chamber, and inhibiting escape of the electrons and the plasma from a region outside the arc chamber in proximity to the filament and the indirectly heated cathode.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
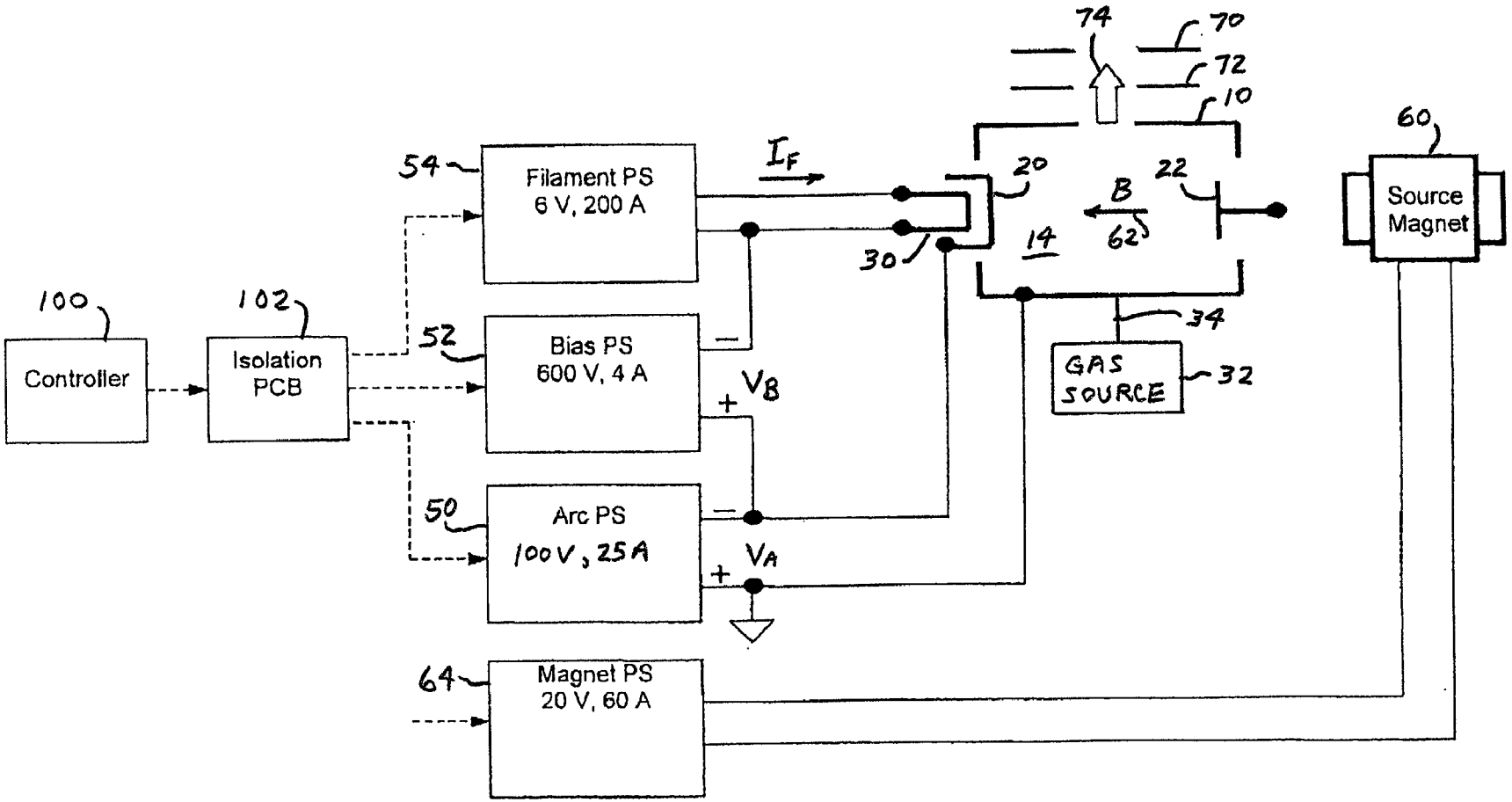
FIG. 1 is a schematic block diagram of an indirectly heated cathode ion source in accordance with an embodiment of the invention.

An indirectly heated cathode ion source in accordance with an embodiment of the invention is shown in FIG. 1. An arc chamber housing 10 having an extraction aperture 12 defines an arc chamber 14. A cathode 20 and a repeller electrode 22 are positioned within arc chamber 14. A filament 30, positioned outside arc chamber 14 in close proximity to cathode 20, produces heating of cathode 20.

A gas to be ionized is provided from a gas source 32 to arc chamber 14 through a gas inlet 34. In another configuration, not shown, arc chamber 14 may be coupled to a vaporizer which vaporizes a material to be ionized in arc chamber 14.

An arc power supply 50 has a positive terminal connected to arc chamber housing 10 and a negative terminal connected to cathode 20. Repeller electrode 22 can be floating as shown in FIG. 1 or can be connected to the negative terminal of arc power supply 50. Arc power supply 50 may have a rating of 100 volts at 25 amperes and may operate at about 70 volts. The arc power supply 50 accelerates electrons emitted by cathode 20 into the plasma in arc chamber 14.

A bias power supply 52 has a positive terminal connected to cathode 20 and a negative terminal connected to filament 30. The bias power supply 52 may have a rating of 600 volts at 4 amperes and may operate at a current of about 2.5 amperes and a voltage of about 350 volts. The bias power supply 52 accelerates electrons emitted by filament 30 to cathode 20 to produce heating of cathode 20.

A filament power supply 54 has output terminals connected to filament 30. Filament power supply 54 may have a rating of 6 volts at 200 amperes and may operate at a filament current of about 140 to 170 amperes. The filament power supply 54 produces heating of filament 30, which in turn generates electrons that are accelerated toward cathode 20 for heating of cathode 20.

A source magnet 60 produces a magnetic field B within arc chamber 14 in a direction indicated by arrow 62. Typically, source magnet 60 includes poles at opposite ends of arc chamber 14. The direction of the magnetic field B may be reversed without affecting operation of the ion source. Source magnet 60 is connected to a magnet power supply 64, which may have a rating of 20 volts at 60 amperes. The magnetic field produces increased interaction between electrons emitted by cathode 20 and the plasma in arc chamber 14.

It will be understood that the voltage and current ratings and the operating voltages and currents of power supplies 50, 52, 54 and 64 are given by way of example only and are not limiting as to the scope of the invention.

An extraction electrode 70 and a suppression electrode 72 are positioned in front of extraction aperture 12. Each of extraction electrode 70 and suppression electrode 72 have an aperture aligned with extraction aperture 12 for extraction of a well-defined ion beam 74. Extraction electrode 70 and suppression electrode 72 are connected to respective power supplies (not shown).

An ion source controller 100 provides control of the ion source through an isolation circuit 102. In other embodiments, circuitry for performing the isolation function may be built into power supplies 50, 52 and 54. The ion source controller 100 may be a programmed controller or a dedicated special purpose controller. In one embodiment, the ion source controller is incorporated into the main control computer of the ion implanter.

When the ion source is in operation, the filament 30 is heated resistively by filament current $I_F$ to thermionic emission temperatures, which may be on the order of 2200° C. Electrons emitted by filament 30 are accelerated by the bias voltage $V_B$ between filament 30 and cathode 20 and bombard and heat cathode 20. The cathode 20 is heated by electron bombardment to thermionic emission temperatures. Electrons emitted by cathode 20 are accelerated by arc voltage $V_A$ and ionize gas molecules from gas source 32 within arc chamber 14 to produce a plasma discharge. The electrons within arc chamber 14 are caused to follow spiral trajectories by magnetic field B. Repeller electrode 22 builds up a negative charge as a result of incident electrons and eventually has a sufficient negative charge to repel electrons back through arc chamber 14, producing additional ionizing collisions. The ion source of FIG. 1 exhibits good source lifetime because the filament 30 is not exposed to the plasma in arc chamber 14, and cathode 20 is more massive than conventional directly heated cathodes.

An ion source in accordance with an embodiment of the invention is shown in FIGS. 2A–9. Like elements in FIGS. 1–9 have the same reference numerals. The power supplies 50, 52, 54 and 64, controller 100, isolation circuit 102, gas source 32 and source magnet 60 are not shown in FIGS. 2A–9.

Figure 2A:
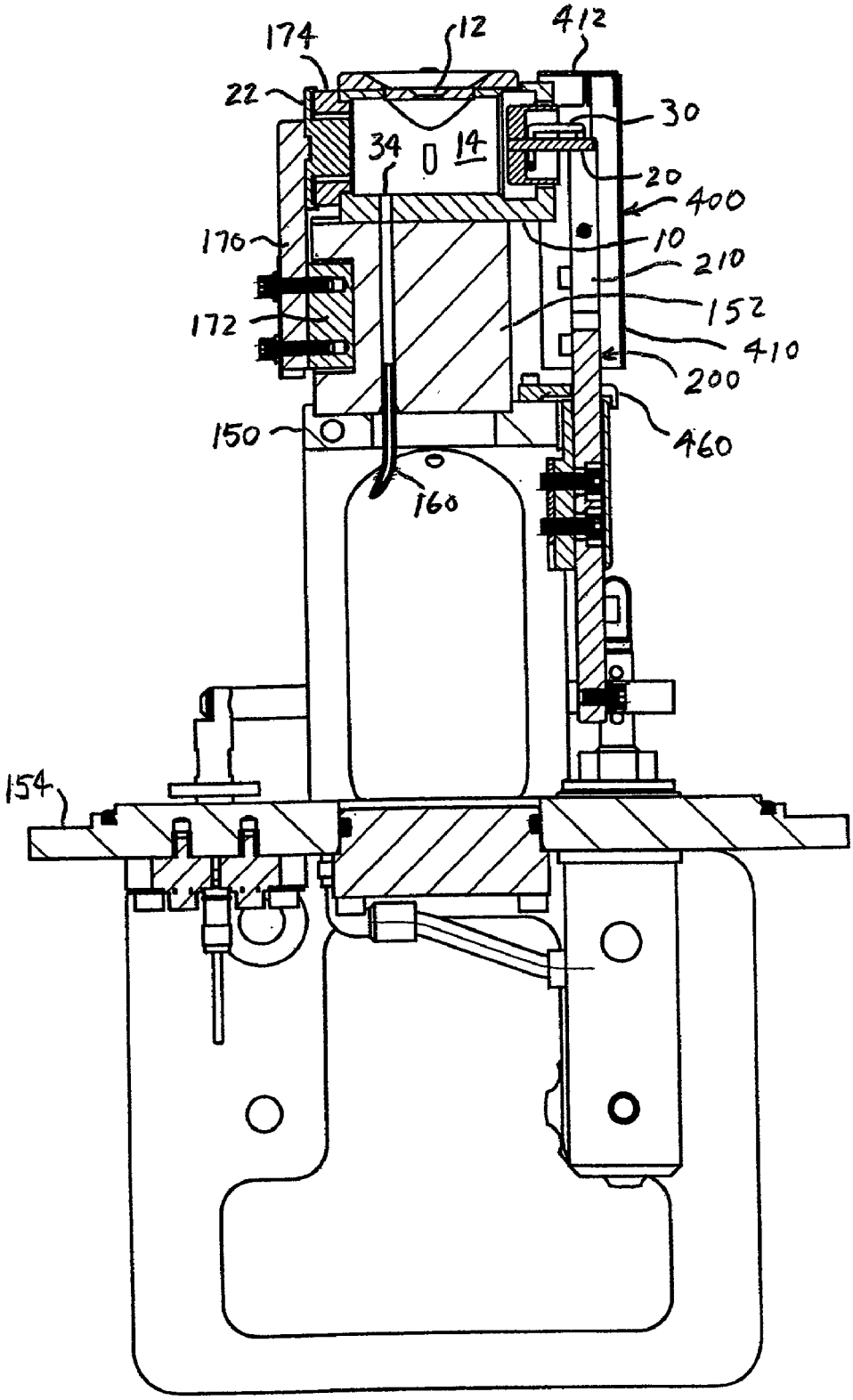
FIG. 2A is a cross-sectional diagram of an indirectly heated cathode ion source in accordance with an embodiment of the invention.
Figure 2B:
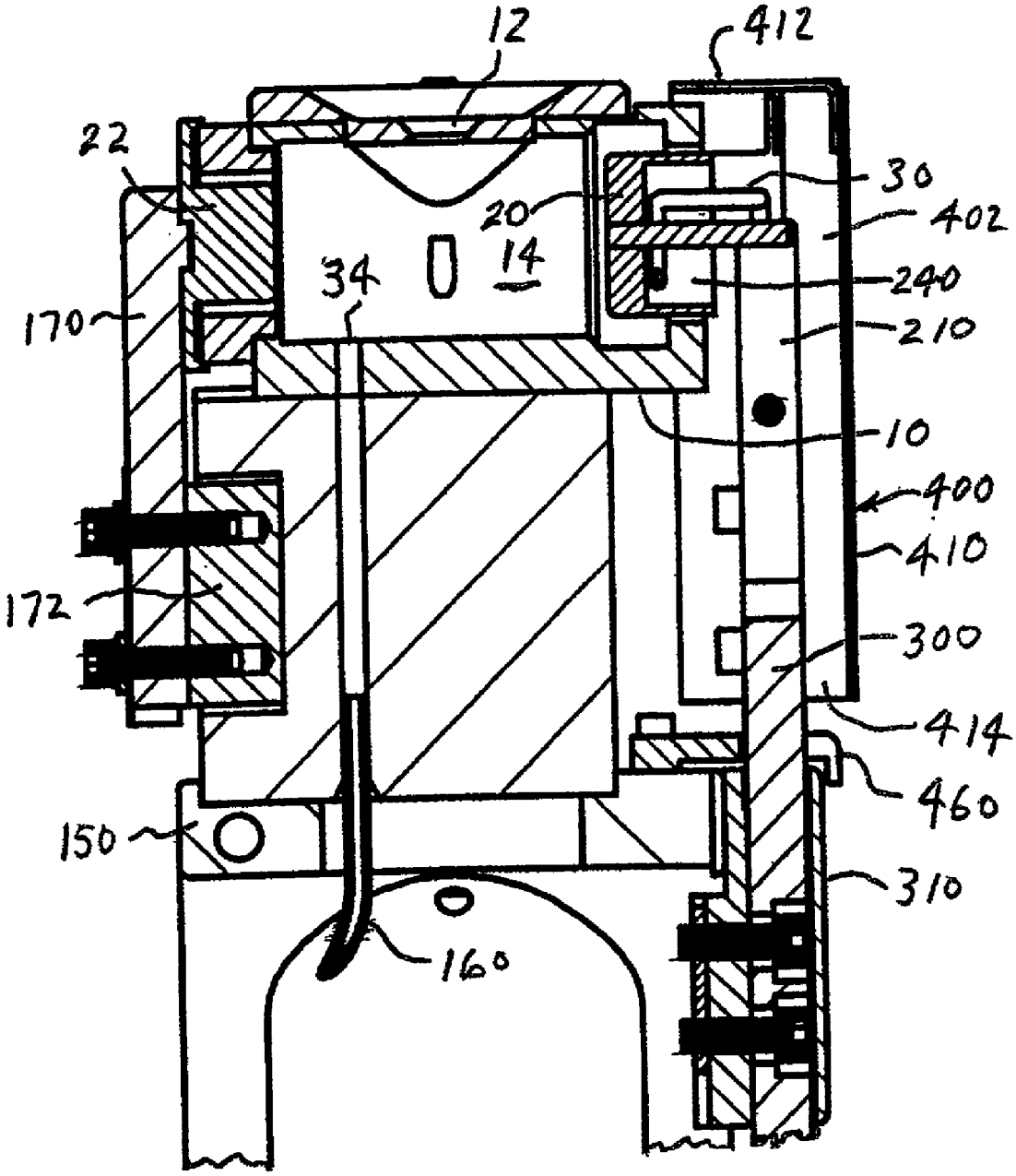
FIG. 2B is an enlarged cross-sectional diagram of the indirectly heated cathode ion source of FIG. 2A, showing the arc chamber and related components.

Referring to FIGS. 2A and 2B, arc chamber 10 is supported by an ion source body 150 and an arc chamber base 152. A plate 154, which is part of ion source body 150, defines a boundary between the vacuum region of the ion source and the external environment. A tube 160 provides a connection between gas inlet 34 of arc chamber 14 and gas source 32 (FIG. 1).

As further shown in FIGS. 2A and 2B, repeller electrode 22 is mounted to arc chamber base 152 by a conductive support member 170 and an insulator 172. Repeller electrode 22 is electrically isolated from arc chamber 10 by an insulator 174.

As shown in FIGS. 2A, 2B, 3 and 4, a cathode assembly 200 includes cathode 20, filament 30 and a clamp assembly 210 for mounting cathode 20 and filament 30 in a fixed spatial relationship and for conducting electrical energy to cathode 20 and filament 30. As shown in FIGS. 2A and 2B, cathode 20 is mounted in an opening at one end of arc chamber housing 10 but does not physically contact arc chamber housing 10. Preferably, a gap between cathode 20 and arc chamber housing 10 is on the order of about 0.050 inch.

Figure 5:
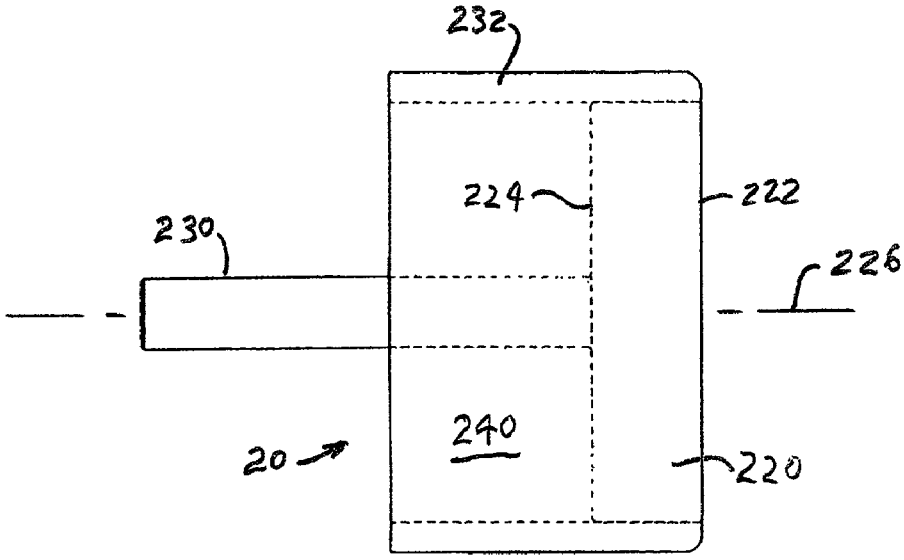
FIG. 5 is a side view, partly in phantom, of the indirectly heated cathode utilized in the ion source of FIGS. 2A and 2B.

An embodiment of cathode 20 is shown in FIG. 5. Cathode 20 includes a disc-shaped emitting portion 220 having a front surface 222, a rear surface 224, and an axis of symmetry 226. A support rod 230 extends rearwardly from rear surface 224 and is preferably located on axis 226. A skirt 232 extends rearwardly from the outer periphery of emitting portion 220. Skirt 232 may have a cylindrical shape and preferably has a relatively thin wall to limit conduction of thermal energy. Emitting portion 220 and skirt 232 define a cup-shaped cavity 240 adjacent to rear surface 224 of emitting portion 220. As described below, filament 30 is mounted in cavity 240 in proximity to rear surface 224 and is shielded from the plasma in arc chamber 14 by skirt 232. In one example, cathode 20 is fabricated of tungsten.

Support rod 230 is used for mechanical mounting of cathode 20 and conducts electrical energy to cathode 20. Preferably, support rod 230 has a small diameter relative to emitting portion 220 to limit thermal conduction and radiation. In one embodiment, support rod 230 has a diameter of 0.125 inch and a length of 0.759 inch, and is attached to the center of rear surface 224 of emitting portion 220.

Skirt 232 functions to shield filament 30 from the plasma in arc chamber 14, but is not used for mechanical mounting of cathode 20 or for conducting electrical energy to cathode 20. In particular, skirt 232 does not physically contact the clamp assembly used for mounting cathode 20 in the arc chamber and does not physically contact arc chamber housing 10. In one embodiment, skirt 32 has a wall thickness of about 0.050 inch and has a axial length of about 0.560 inch.

Emitting portion 220 is relatively thick and functions as the main electron emitter for the ion source. In one embodiment, emitting portion 220 has a diameter of 0.855 inch and thickness of 0.200 inch. It will be understood that the above dimensions are given by way of example only and are not limiting to the scope of the invention.

Figure 6:
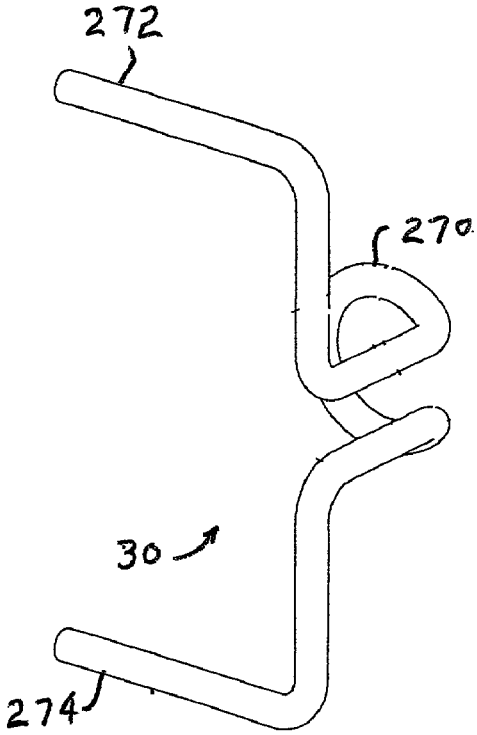
FIG. 6 is a perspective view of the filament utilized in the ion source of FIGS. 2A and 2B.

An example of filament 30 is shown in FIG. 6. In this example, filament 30 is fabricated of conductive wire and includes a heating loop 270 and connecting leads 272 and 274. Connecting leads 272 and 274 are provided with appropriate bends for attachment of filament 30 to clamp assembly 210, as shown in FIGS. 2A, 2B, 3 and 4. In the example of FIG. 6, heating loop 270 is configured as a single, arc-shaped turn having an inside diameter greater than or equal to the diameter of support rod 230, so as to accommodate support rod 230. In the example of FIG. 6, heating loop 270 has an inside diameter of 0.360 inch and an outside diameter of 0.540 inch. Filament 30 may be fabricated of tungsten wire having a diameter of 0.090 inch. Preferably, the wire along the length of the heating loop 270 is ground or otherwise reduced to a smaller cross-sectional area in a region adjacent to cathode 20 for increased resistance and increased heating in close proximity to cathode 20 and decreased heating of connecting leads 272 and 274. Heating loop 270 may be spaced from rear surface 224 of emitting portion 220 by about 0.024–0.028 inch.

Figure 3:
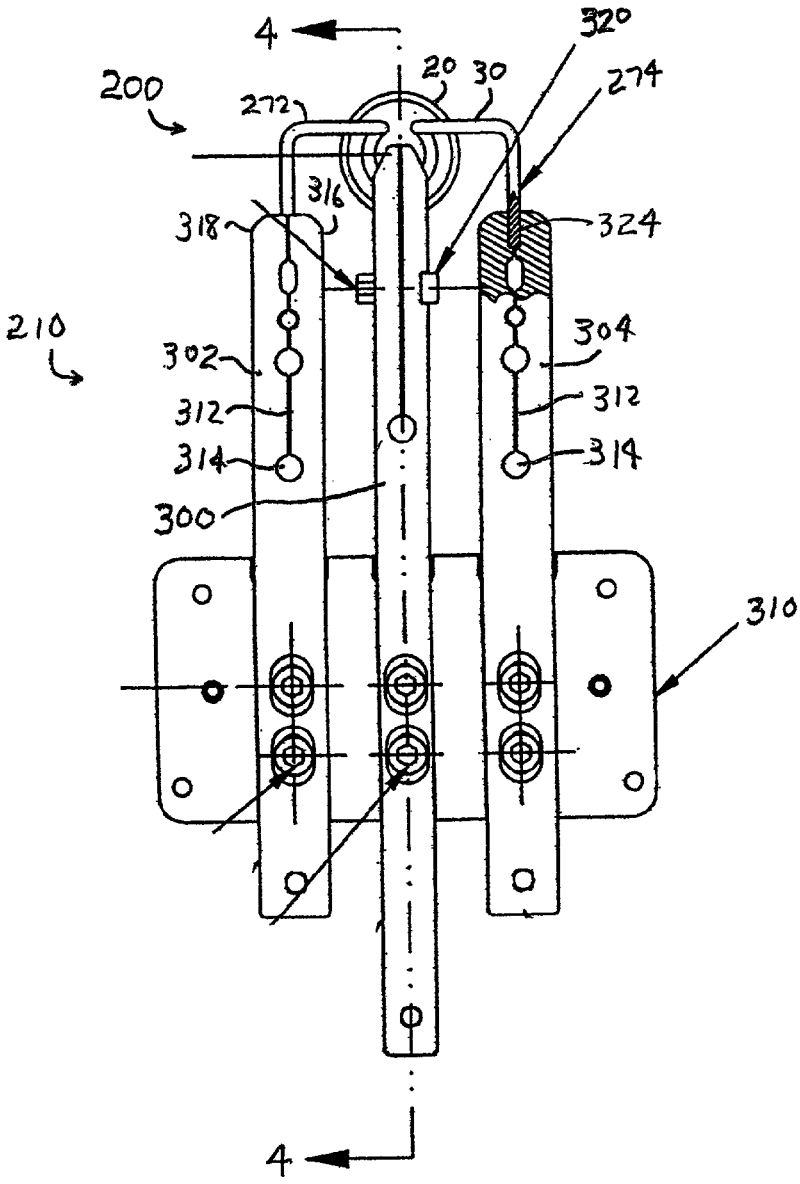
FIG. 3 is a elevation view of a cathode assembly utilized in the ion source of FIGS. 2A and 2B.
Figure 4:
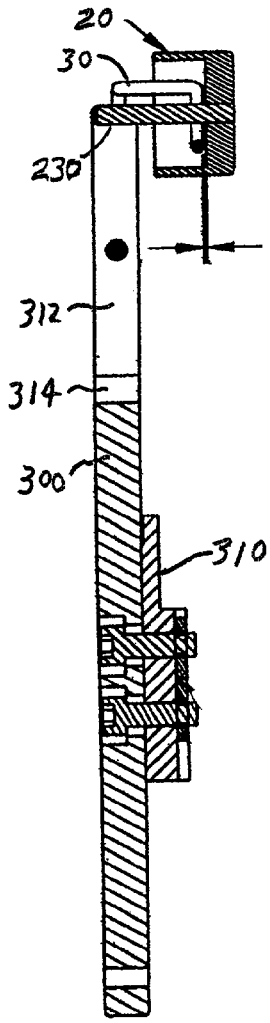
FIG. 4 is a cross-sectional diagram of the cathode assembly, taken along the line 4—4 of FIG. 3.

As best shown in FIG. 3, clamp assembly 210 may include a cathode clamp 300, filament clamps 302 and 304, and an insulator block 310. Cathode clamp 300 and filament clamps 302 and 304 are mounted in fixed positions to insulator block 310 and are electrically isolated from each other. Each of clamps 300, 302 and 304 may be fabricated as a conductive metal strip having a lengthwise slit 312 and one or more holes 314 which define spreadable fingers 316 and 318. The spreadable fingers 316 and 318 may include a hole for receiving a filament lead in the case of filament clamps 302 and 304 or for receiving support rod 230 in the case of cathode clamp 300. Filament clamps 302 and 304 may include respective blind holes 324 dimensioned for positioning filament 30 relative to cathode 20. Cathode clamp 300 may include a screw 320 for securing the fingers of cathode clamp 300 together after proper positioning of cathode 20 relative to filament 30. Cathode clamp 300 and filament clamps 302 and 304 extend below insulator block 310 for electrical connection to the respective power supplies, as shown in FIG. 1 and described above.

Referring again to FIGS. 2A and 2B, it may observed that skirt 232 effectively shields filament 30 from the plasma in arc chamber 14. Thus, sputtering of and damage to filament 30 is limited. Although there is a gap between cathode 20 and arc chamber housing 10, the heating loop of filament 30 is located within cup-shaped cavity 240 and migration of the plasma from arc chamber 14 to filament 30 is minimal. Thus, a long operating lifetime is achieved, and the cathode insulator used in prior art ion sources is eliminated.

Figure 7:
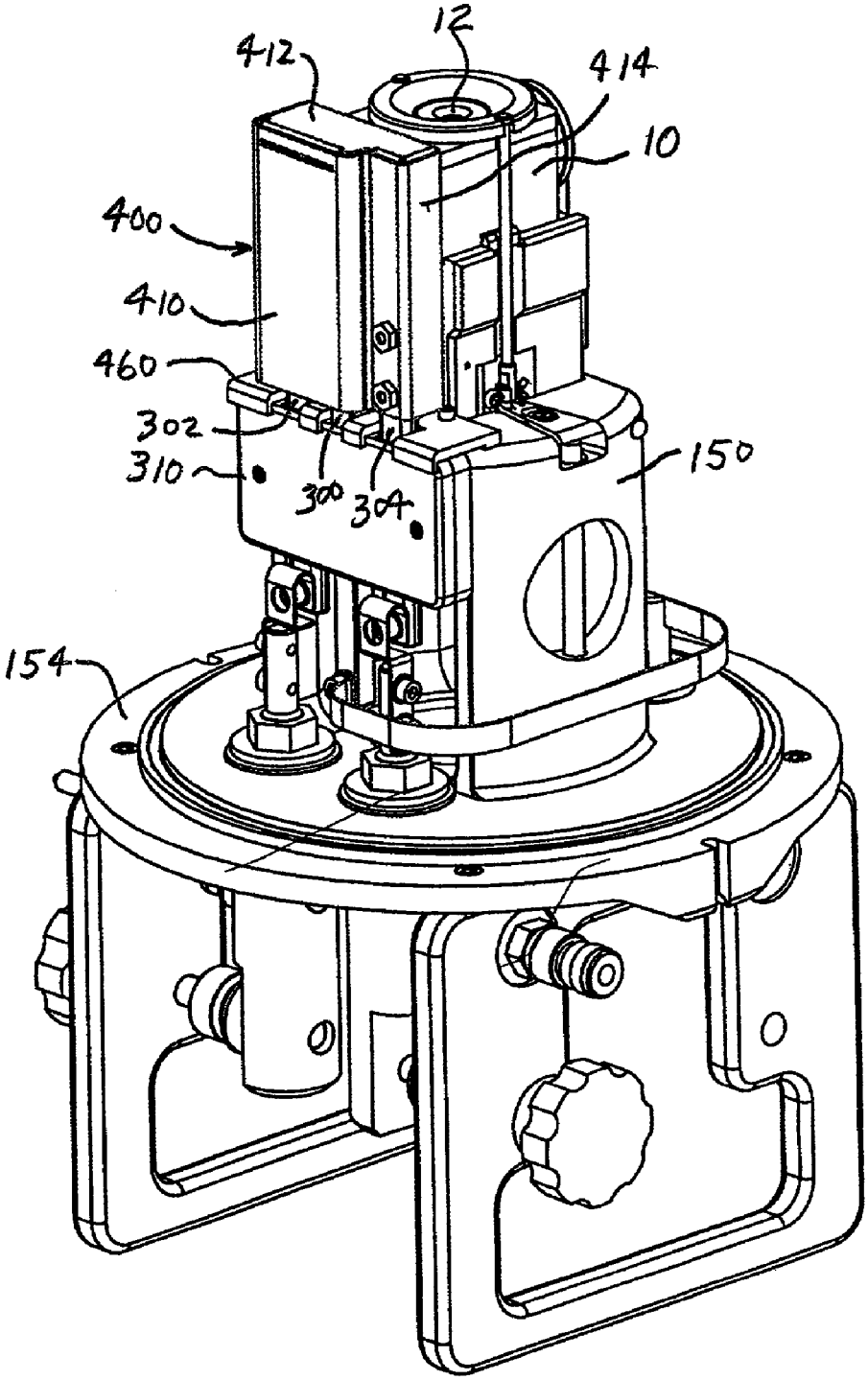
FIG. 7 is a perspective view of the indirectly heated cathode ion source of FIGS. 2A and 2B.

The ion source may further include a shield 400, as best shown in FIGS. 2A, 2B and 7. Shield 400 substantially encloses a region 402 outside arc chamber 14 in proximity to cathode 20 and filament 30. A function of shield 400 is to form a barrier to electrons and plasma in the vicinity of cathode 20 and filament 30. Shield 400 substantially encloses region 402 in the sense that it forms a barrier to electrons and plasma but does not seal region 402

The shield 400 may have a box-like structure and may be fabricated of a refractory metal. In the embodiment of FIGS. 2A, 2B and 7, shield 400 includes a two-level main wall 410, a top wall 412, a first side wall 414 and a second side wall (not shown). The two-level main wall 410 permits shield 400 to be electrically and mechanically connected to filament clamp 304 and to be spaced from filament clamp 302 and cathode clamp 300. It will be understood that different shield configurations may be utilized. For example, shield 400 may have a flat main wall and may be mounted to filament clamp 304 using standoffs. Furthermore, shield 400 may be mounted to another element of the ion source.

As noted above, shield 400 substantially encloses region 402 outside arc chamber 14 in proximity to cathode 20 and filament 30. Operation of the ion source involves generation of electrons by filament 30 and cathode 20, and formation of a plasma in arc chamber 14. Under ideal conditions, the electrons generated by filament 30 impact cathode 20, the electrons generated by cathode 20 remain within arc chamber 14, and, the plasma remains within arc chamber 14. However, in a practical ion source, the electrical potentials on various components, such as the vacuum vessel that encloses the ion source and components of the extraction system, may result in undesired electron emission, arcing and/or and plasma formation. Such undesired conditions may degrade the stability of the ion source and may reduce its lifetime. The space between cathode 20 and arc chamber housing 10 provides a path for escape of plasma from arc chamber 14. The shield 400 effectively isolates the vacuum vessel and the components of the extraction system from filament 30, cathode 20 and arc chamber 14.

Figure 8:
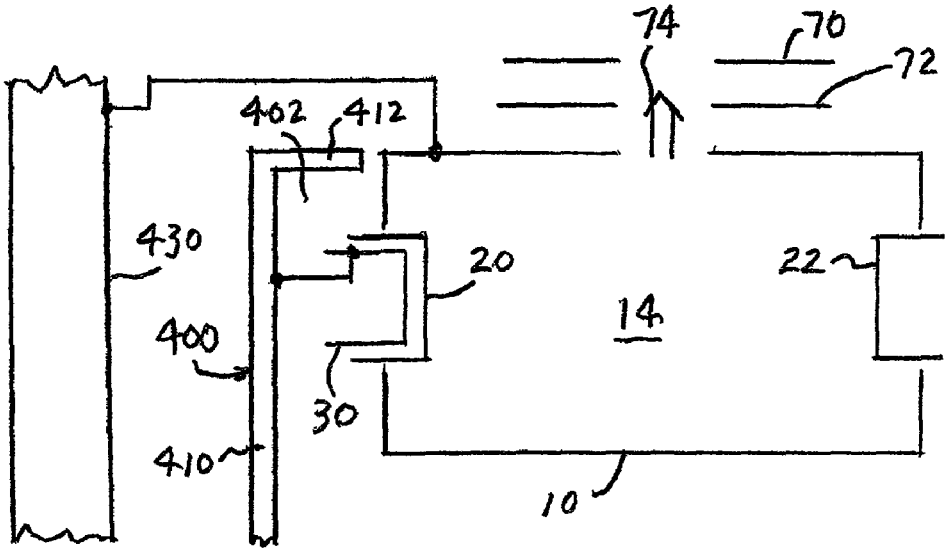
FIG. 8 is a schematic diagram that illustrates the electrical connection of the shield and the vacuum vessel in accordance with a first embodiment.
Figure 9:
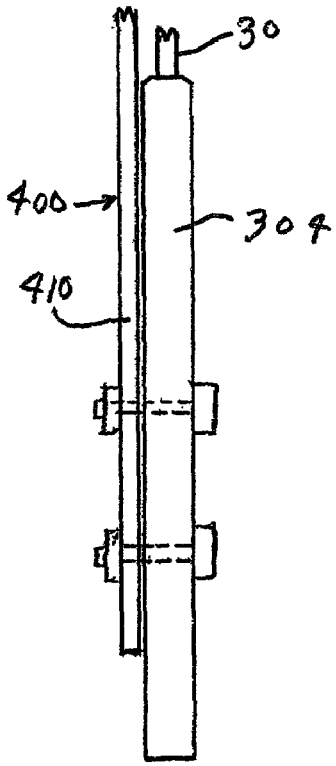
FIG. 9 is a partial cross-sectional diagram of the ion source that illustrates mounting of the shield to a filament clamp in the first embodiment.

A first embodiment of shield 400 and related ion source components is shown in FIGS. 8 and 9. A section of a vacuum vessel 430 is shown for purposes of illustration. Vacuum vessel 430 encloses components of the ion source and defines the boundary between the controlled environment of the ion source and the external atmosphere. In this embodiment, vacuum vessel 430 is electrically connected to the potential of arc chamber housing 10. In the absence of shield 400, electrons from filament 30 and cathode 20 may impact vacuum vessel 30 and may cause damage to vacuum vessel 30. In the embodiment of FIGS. 8 and 9, shield 400 is electrically connected to the positive terminal of filament 30. As illustrated in FIG. 9, shield 400 is mechanically and electrically affixed to filament clamp 304. The two-level main wall 410 permits shield 400 to be directly secured to filament clamp 304, as shown in FIGS. 7 and 9, while preventing physical contact between shield 400 and filament clamp 302 or cathode clamp 300. As shown in FIG. 8, shield 400 substantially encloses region 402 outside arc chamber 14 in proximity to filament 30 and cathode 20. Shield 400 thus functions as a barrier. Cathode 20 and filament 30 are located on one side of the barrier formed by shield 400, and vacuum vessel 430 and components of the extraction system, such as electrodes 70 and 72, are located on the opposite side of the barrier.

Figure 10:
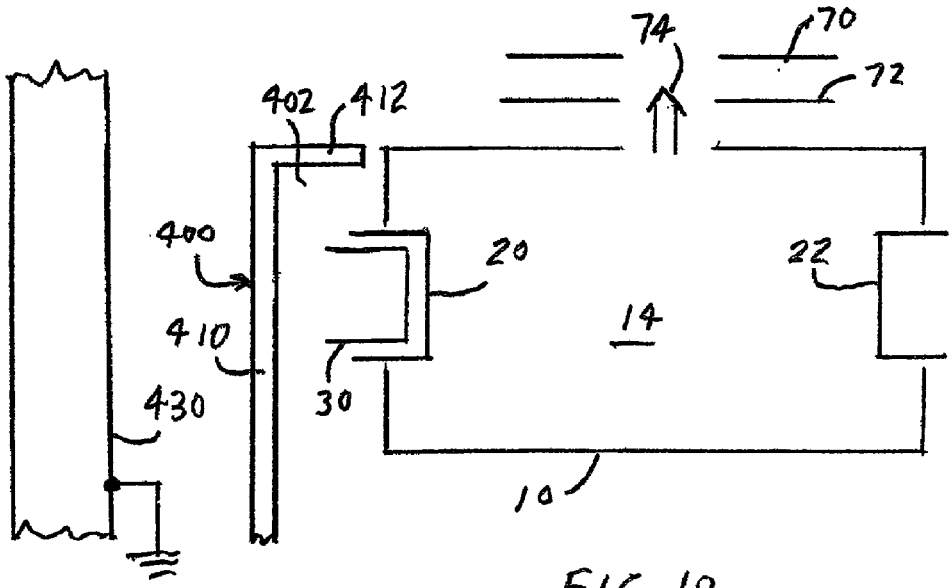
FIG. 10 is a schematic diagram that illustrates electrical connection of the shield and the vacuum vessel in accordance with a second embodiment.
Figure 11:
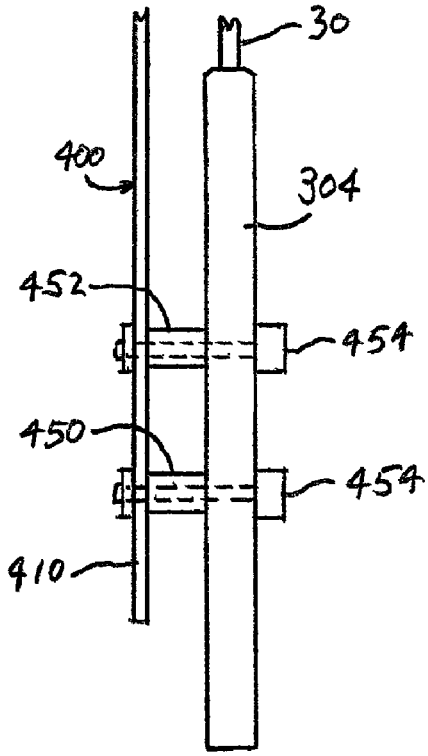
FIG. 11 is a partial cross-sectional diagram of the ion source that illustrates mounting of the shield to a filament clamp in the second embodiment.

A second embodiment of shield 400 and related ion source components is shown in FIGS. 10 and 11. In the embodiment of FIGS. 10 and 11, vacuum vessel 430 is connected to ground and shield 400 is electrically floating. As shown in FIG. 11, shield 400 may be mounted to filament clamp 304 using insulating standoffs 450 and 452 and insulating mounting hardware 454 to ensure electrical isolation between shield 400 and filament clamp 304. Alternatively, shield 400 may be mounted to another component of the ion source using insulating standoffs. As in the first embodiment, shield 400 substantially encloses region 402 outside arc chamber 14 in proximity to filament 30 and cathode 20 and functions as a barrier.

Shield 400 may have any suitable size and shape and is not limited to a box-like structure. The shield 400 substantially may be fabricated of a refractory metal such as tantalum, tungsten, molybdenum or niobium, for example. Because of the severe environment within the ion source, shield 400 should be resistant to high temperatures and corrosive materials.

Shield 400 permits the elimination of an insulator between cathode 20 and arc chamber housing 10, which has been used to inhibit escape of plasma from arc chamber 14 while electrically isolating cathode 20 from arc chamber housing 10. The insulator in this location is subject to conductive deposits which can reduce the lifetime of the ion source.

The ion source may further include an insulator shield 460 between insulator block 310 and cathode 20 (see FIGS. 2A, 2B and 7). Insulator shield 460 may be a refractory metal element attached to ion source body 150. Insulator shield 460 has cutouts to provide electrical isolation from cathode clamp 300 and filament clamps 302 and 304. Insulator shield 460 inhibits buildup of deposits on insulator block 310 which otherwise could produce a short circuit between one or more cathode clamp 300 and filament clamps 302 and 304.

The above description is intended to be illustrative and not exhaustive. The description will suggest many variations and alternatives to one of ordinary skill in this art. All these alternatives and variations are intended to be included within the scope of the attached claims. Those familiar with the art may recognize other equivalents to be specific embodiments described herein which equivalents are also intended to be encompassed by the claims attached hereto. Further, the particular features presented in the independent claims below can be combined with each other in other manners within the scope of the invention such that the invention should be recognized as also specifically directed to other embodiments having any other possible combination of the features of the dependent claims.

What is claimed:

1. An indirectly heated cathode ion source comprising:

an arc chamber housing defining an arc chamber;

an indirectly heated cathode positioned within the arc chamber, said indirectly heated cathode comprising an emitting portion having a front surface, a rear surface and a periphery, a support rod attached to the rear surface of the emitting portion and a skirt extending from the periphery of the emitting portion; and a filament positioned outside of the arc chamber which emits electrons for bombarding and heating the indirectly heated cathode.

2. An indirectly heated cathode ion source comprising:

an arc chamber housing defining an arc chamber;

an indirectly heated cathode positioned within the arc chamber, said indirectly heated cathode comprising an emitting portion having a front surface, a rear surface and a periphery, a support rod attached to the rear surface of the emitting portion and a skirt extending from the periphery of the emitting portion;

a filament positioned outside of the arc chamber for heating the indirectly heated cathode; and a clamp assembly for mounting the cathode and the filament in a fixed spatial relationship and for conducting electrical energy to the cathode and the filament.

3. An indirectly heated cathode ion source as defined in claim 2, wherein said clamp assembly comprises a cathode clamp affixed to the support rod of said cathode, first and second filament clamps affixed to first and second connecting leads, respectively, of said filament, and an insulator block, wherein said cathode clamp and said first and second filament clamps are mounted in fixed positions to said insulator block.

4. An indirectly heated cathode ion source comprising:

an arc chamber housing defining an arc chamber;

an indirectly heated cathode positioned within the arc chamber, said indirectly heated cathode comprising an emitting portion having a front surface, a rear surface and a periphery, a support rod attached to the rear surface of the emitting portion and a skirt extending from the periphery of the emitting portion; and a filament positioned outside of the arc chamber for heating the indirectly heated cathode;

wherein the skirt and the emitting portion define a cavity and wherein the filament is positioned within the cavity and is thereby protected against exposure to a plasma in the arc chamber.

5. An indirectly heated cathode ion source as defined in claim 1, further comprising:

a filament power supply for providing current for heating the filament;

a bias power supply coupled between the filament and the cathode; and an arc power supply coupled between the cathode and the arc chamber housing.

6. An indirectly heated cathode ion source comprising:

an arc chamber housing defining an arc chamber;

an indirectly heated cathode positioned within the arc chamber;

a filament positioned outside the arc chamber which emits electrons for bombarding and heating the indirectly heated cathode; and a shield positioned entirely outside the arc chamber in proximity to the filament and the indirectly heated cathode, wherein the shield defines a first region on one side of the shield and a second region on an opposite side of the shield, wherein the arc chamber, the filament, and the indirectly heated cathode are positioned within the first region.

7. An indirectly heated cathode ion source comprising:

an arc chamber housing defining an arc chamber;

an indirectly heated cathode positioned within the arc chamber;

a filament positioned outside the arc chamber for heating the indirectly heated cathode;

a shield positioned entirely outside the arc chamber in proximity to the filament and the indirectly heated cathode, wherein the shield defines a first region on one side of the shield and a second region on an opposite side of the shield, wherein the arc chamber, the filament, and the indirectly heated cathode are positioned within the first region; and a vacuum vessel enclosing the arc chamber, the indirectly heated cathode, the filament and the shield, wherein an adjacent portion of the vacuum vessel is located in the second region.

8. An indirectly heated cathode ion source comprising:

an arc chamber housing defining an arc chamber;

an indirectly heated cathode positioned within the arc chamber;

a filament positioned outside the arc chamber for heating the indirectly heated cathode;

a shield positioned entirely outside the arc chamber in proximity to the filament and the indirectly heated cathode, wherein the shield defines a first region on one side of the shield and a second region on an opposite side of the shield, wherein the arc chamber, the filament, and the indirectly heated cathode are positioned within the first region; and a clamp assembly for mounting the cathode and the filament in a fixed spatial relationship and for conducting electrical energy to the cathode and the filament, wherein the shield is mounted to the clamp assembly.

9. An indirectly heated cathode ion source as defined in claim 8, wherein the clamp assembly comprises an insulator block, said ion source further comprising an insulator shield for inhibiting buildup of contaminants on the insulator block.

10. An indirectly heated cathode ion source comprising:

an arc chamber housing defining an arc chamber;

an indirectly heated cathode positioned within the arc chamber;

a filament positioned outside the arc chamber for heating the indirectly heated cathode; and a shield positioned entirely outside the arc chamber in proximity to the filament and the indirectly heated cathode, wherein the shield defines a first region on one side of the shield and a second region on an opposite side of the shield, wherein the arc chamber, the filament, and the indirectly heated cathode are positioned within the first region;

wherein the shield comprises a metal box having one or more sides missing.

11. An indirectly heated cathode ion source comprising:

an arc chamber housing defining an arc chamber;

an indirectly heated cathode positioned within the arc chamber;

a filament positioned outside the arc chamber for heating the indirectly heated cathode;

a shield positioned entirely outside the arc chamber in proximity to the filament and the indirectly heated cathode, wherein the shield defines a first region on one side of the shield and a second region on an opposite side of the shield, wherein the arc chamber, the filament, and the indirectly heated cathode are positioned within the first region; and wherein the shield comprises a refractory metal.

12. An indirectly heated cathode ion source as defined in claim 6, further comprising:

a filament power supply for providing current for heating the filament;

a bias power supply coupled between the filament and the cathode; and an arc power supply coupled between the cathode and the arc chamber housing.

13. An indirectly heated cathode ion source comprising:

an arc chamber housing defining an arc chamber;

an indirectly heated cathode positioned within the arc chamber;

a filament positioned outside the arc chamber which emits electrons for bombarding and heating the indirectly heated cathode, wherein the indirectly heated cathode provides electrons for generating a plasma within the arc chamber; and means for inhibiting escape of the electrons and the plasma from a first region outside the arc chamber in proximity to the filament and the indirectly heated cathode wherein the means for inhibiting escape defines the first region on one side of the means for inhibiting escape and a second region on an opposite side of the means for inhibiting escape, wherein the arc chamber, the filament, and the indirectly heated cathode are positioned within the first region.

14. An indirectly heated cathode ion source as defined in claim 13, wherein said means for inhibiting escape comprises a shield positioned outside the arc chamber in proximity to the filament and the indirectly heated cathode.

15. An indirectly heated cathode ion source as defined in claim 14, further comprising a vacuum vessel enclosing the arc chamber, the indirectly heated cathode, the filament and the shield, wherein an adjacent portion of the vacuum vessel in the second region.

16. An indirectly heated cathode ion source as defined in claim 14, further comprising a vacuum vessel enclosing the arc chamber, the indirectly heated cathode, the filament and the shield, wherein the shield forms a barrier between the filament and the indirectly heated cathode in the first region and the vacuum vessel in the second region.

17. An indirectly heated cathode ion source as defined in claim 14, further comprising components of an extraction system for extracting an ion beam from the arc chamber, wherein the shield forms a barrier between the filament and the indirectly heated cathode in the first region and the components of the extraction system in the second region.

18. A method for operating an ion source, comprising:

providing an arc chamber housing that defines an arc chamber;

positioning an indirectly heated cathode within the arc chamber;

heating the indirectly heated cathode with a filament positioned outside the arc chamber by emitting electrons and bombarding the indirectly heated cathode for generating a plasma within the arc chamber; and inhibiting escape of the electrons and the plasma from a region outside the arc chamber in proximity to the filament and the indirectly heated cathode;

wherein the step of inhibiting the escape of the electrons and the plasma comprises positioning a shield entirely outside the arc chamber in proximity to the filament and the indirectly heated cathode, wherein the shield defines a first region on one side of the shield and a second region on an opposite side of the shield, wherein the arc chamber, the filament, and the indirectly heated cathode are positioned within the first region.

19. A method for operating an ion source comprising:

providing an arc chamber housing that defines an arc chamber;

positioning an indirectly heated cathode within the arc chamber;

heating the indirectly heated cathode with a filament positioned outside the arc chamber to provide electrons for generating a plasma within the arc chamber; and inhibiting escape of the electrons and the plasma from a region outside the arc chamber in proximity to the filament and the indirectly heated cathode;

wherein the step of inhibiting the escape of the electrons and the plasma comprises positioning a shield entirely outside the arc chamber in proximity to the filament and the indirectly heated cathode, wherein the shield defines a first region on one side of the shield and a second region on an opposite side of the shield, wherein the arc chamber, the filament, and the indirectly heated cathode are positioned within the first region.

20. A method as defined in claim 18, wherein the step of inhibiting the escape of the electrons and the plasma comprises providing the shield between the filament and components of an extraction system.

21. A method as defined in claim 18, wherein the step of inhibiting the escape of the electrons and the plasma comprises substantially enclosing the region outside the arc chamber in proximity to the filament and the indirectly heated cathode.

22. An indirectly heated cathode ion source comprising:

an arc chamber housing defining an arc chamber;

an indirectly heated cathode positioned within the arc chamber;

a filament positioned outside the arc chamber for heating the indirectly heated cathode;

a shield positioned outside the arc chamber in proximity to the filament and the indirectly heated cathode; and a vacuum vessel enclosing the arc chamber, the indirectly heated cathode, the filament and the shield;

wherein the filament and the indirectly heated cathode are located on one side of the shield and an adjacent portion of the vacuum vessel is located on an opposite side of the shield, and wherein the arc chamber housing and the vacuum vessel are at a common potential and the shield is at filament potential.

23. An indirectly heated cathode ion source comprising:

an arc chamber housing defining an arc chamber;

an indirectly heated cathode positioned within the arc chamber;

a filament positioned outside the arc chamber for heating the indirectly heated cathode;

a shield positioned outside the arc chamber in proximity to the filament and the indirectly heated cathode; and a vacuum vessel enclosing the arc chamber, the indirectly heated cathode, the filament and the shield;

wherein the filament and the indirectly heated cathode are located on one side of the shield and an adjacent portion of the vacuum vessel is located on an opposite side of the shield, and wherein the vacuum vessel is connected to a reference potential and the shield is electrically floating.

24. An indirectly heated cathode ion source comprising:

an arc chamber housing defining an arc chamber;

an indirectly heated cathode positioned within the arc chamber;

a filament positioned outside the arc chamber for heating the indirectly heated cathode; and a shield positioned entirely outside the arc chamber in proximity to the filament and the indirectly heated cathode; and a clamp assembly for mounting the cathode and the filament in a fixed spatial relationship and for conducting electrical energy to the cathode and the filament, the clamp assembly comprising first and second filament clamps affixed to first and second connecting leads, respectively, of the filament and wherein the shield is mechanically and electrically connected to one of the first and second filament clamps.

25. An indirectly heated cathode ion source comprising:

an arc chamber housing defining an arc chamber;

an indirectly heated cathode positioned within the arc chamber;

a filament positioned outside the arc chamber for heating the indirectly heated cathode; and a shield positioned entirely outside the arc chamber in proximity to the filament and the indirectly heated cathode; and a clamp assembly for mounting the cathode and the filament in a fixed spatial relationship and for conducting electrical energy to the cathode and the filament, the clamp assembly comprising first and second filament clamps affixed to first and second connecting leads, respectively, of the filament and wherein the shield is mechanically mounted by electrical insulators to one of the first and second filament clamps.

26. An indirectly heated cathode ion source comprising:

an arc chamber housing defining an arc chamber;

an indirectly heated cathode positioned within the arc chamber;

a filament positioned outside the arc chamber for heating the indirectly heated cathode, wherein the indirectly heated cathode provides electrons for generating a plasma within the arc chamber;

means for inhibiting escape of the electrons and the plasma from a region outside the arc chamber in proximity to the filament and the indirectly heated cathode, said means for inhibiting escape comprising a shield positioned outside the arc chamber in proximity to the filament and the indirectly heated cathode; and a vacuum vessel enclosing the arc chamber, the indirectly heated cathode, the filament and the shield;

wherein the filament and the indirectly heated cathode are located on one side of the shield and an adjacent portion of the vacuum vessel is located on an opposite side of the shield and wherein the arc chamber housing and the vacuum vessel are at a common potential and the shield is at filament potential.

27. An indirectly heated cathode ion source comprising:

an arc chamber housing defining an arc chamber;

an indirectly heated cathode positioned within the arc chamber;

a filament positioned outside the arc chamber for heating the indirectly heated cathode, wherein the indirectly heated cathode provides electrons for generating a plasma within the arc chamber;

means for inhibiting escape of the electrons and the plasma from a region outside the arc chamber in proximity to the filament and the indirectly heated cathode, said means for inhibiting escape comprising a shield positioned outside the arc chamber in proximity to the filament and the indirectly heated cathode; and a vacuum vessel enclosing the arc chamber, the indirectly heated cathode, the filament and the shield;

wherein the filament and the indirectly heated cathode are located on one side of the shield and an adjacent portion of the vacuum vessel is located on an opposite side of the shield and wherein the vacuum vessel is connected to a reference potential and the shield is electrically floating.

28. A method for operating an ion source, comprising:

providing an arc chamber housing that defines an arc chamber;

positioning an indirectly heated cathode within the arc chamber;

heating the indirectly heated cathode with a filament positioned outside the arc chamber to provide electrons for generating a plasma within the arc chamber;

inhibiting escape of the electrons and the plasma from a region outside the arc chamber in proximity to the filament and the indirectly heated cathode, the step of inhibiting comprises positioning a shield outside the arc chamber in proximity to the filament and the indirectly heated cathode; and enclosing the arc chamber, the indirectly heated cathode, the filament and the shield within a vacuum vessel, maintaining the vacuum vessel and the arc chamber at a common potential and maintaining the shield at a potential of the filament.

29. A method for operating an ion source, comprising:

providing an arc chamber housing that defines an arc chamber;

positioning an indirectly heated cathode within the arc chamber;

heating the indirectly heated cathode with a filament positioned outside the arc chamber to provide electrons for generating a plasma within the arc chamber;

inhibiting escape of the electrons and the plasma from a region outside the arc chamber in proximity to the filament and the indirectly heated cathode, the step of inhibiting comprises positioning a shield outside the arc chamber in proximity to the filament and the indirectly heated cathode; and enclosing the arc chamber, the indirectly heated cathode, the filament and the shield within a vacuum vessel, maintaining the vacuum vessel at a reference potential and permitting the shield to float electrically.

* * * * *